US008475132B2

(12) United States Patent
Zhang et al.

(10) Patent No.: US 8,475,132 B2
(45) Date of Patent: Jul. 2, 2013

(54) TURBINE BLADE ASSEMBLY

(75) Inventors: Jian Zhang, Simpsonville, SC (US); Herbert Chidsey Roberts, III, Simpsonville, SC (US); John McConnell Delvaux, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 28 days.

(21) Appl. No.: 13/049,179

(22) Filed: Mar. 16, 2011

(65) Prior Publication Data

US 2012/0237355 A1 Sep. 20, 2012

(51) Int. Cl.
*F01D 5/14* (2006.01)

(52) U.S. Cl.
USPC ..... 416/225; 416/226; 416/232

(58) Field of Classification Search
USPC ..... 416/225, 226, 232, 233, 214 R, 214 A, 416/220 R
See application file for complete search history.

(56) References Cited

U.S. PATENT DOCUMENTS

| | | | | |
|---|---|---|---|---|
| 2,328,856 | A | 9/1943 | Stone | |
| 3,269,609 | A | 8/1966 | Ahrens | |
| 3,883,267 | A * | 5/1975 | Baudier et al. | 416/230 |
| 4,285,634 | A * | 8/1981 | Rossman et al. | 416/97 A |
| 4,563,128 | A * | 1/1986 | Rossmann | 416/92 |
| 4,790,721 | A | 12/1988 | Morris et al. | |
| 7,153,096 | B2 | 12/2006 | Thompson et al. | |
| 7,670,116 | B1 | 3/2010 | Wilson, Jr. et al. | |
| 8,033,790 | B2 * | 10/2011 | Vance | 416/97 R |
| 2008/0176020 | A1 * | 7/2008 | Heng et al. | 428/49 |
| 2008/0310965 | A1 * | 12/2008 | Gerakis et al. | 416/97 R |
| 2010/0196087 | A1 | 8/2010 | Langer et al. | |

FOREIGN PATENT DOCUMENTS

WO WO 2007101282 A2 * 9/2007

* cited by examiner

*Primary Examiner* — Nathaniel Wiehe
*Assistant Examiner* — Adam W Brown

(57) ABSTRACT

A turbine blade assembly is disclosed. In one embodiment, the turbine blade assembly may generally include a turbine blade having a root portion and an airfoil. The airfoil may extend radially from the root portion to an airfoil tip. Additionally, the turbine blade assembly may include a composite rod extending within the turbine blade. The composite rod may include a first end coupled to the airfoil at the airfoil tip and a second end coupled to the root portion. Moreover, the coefficient of thermal expansion of the composite rod may be designed to be less than or equal to the coefficient of thermal expansion of the airfoil.

14 Claims, 7 Drawing Sheets

TURBINE BLADE ASSEMBLY

FIELD OF THE INVENTION

The present subject matter relates generally to high temperature components and, more particularly, to a turbine blade assembly that reduces the likelihood of creep and other forms of material relaxations and/or property degradation from occurring within an airfoil of the assembly.

BACKGROUND OF THE INVENTION

In a gas turbine, hot gases of combustion flow from an annular array of combustors through a transition piece for flow along an annular hot gas path. Turbine stages are typically disposed along the hot gas path such that the hot gases of combustion flow from the transition piece through first-stage nozzles and buckets and through the nozzles and buckets of follow-on turbine stages. The turbine buckets may be coupled to a plurality of rotor disks comprising the turbine rotor, with each rotor disk being mounted to the rotor shaft for rotation therewith.

A turbine bucket generally includes a root portion configured to be coupled to one of the rotor disks of the turbine rotor and an airfoil extending radially outwardly from the root portion. In general, during operation of a gas turbine, the hot gases of combustion flowing from the combustors are directed over and around the airfoil. As such, bucket airfoils are prone to damage from thermally induced stresses and strains. For example, airfoils may be subject to creep and other forms of material relaxation and/or property degradation as the components undergo a range of thermo-mechanical loading conditions within the gas turbine. This may be particularly true for turbine buckets formed from composite materials (e.g., ceramic matrix composite materials), as such turbine buckets are not typically air-cooled and, thus, may experience high temperatures throughout the airfoil.

Accordingly, there is a need for a turbine blade assembly that reduces the likelihood of creep and other forms of material relaxations and/or property degradation from occurring within an airfoil during operation of a gas turbine.

BRIEF DESCRIPTION OF THE INVENTION

Aspects and advantages of the invention will be set forth in part in the following description, or may be obvious from the description, or may be learned through practice of the invention.

In one aspect, the present subject matter discloses a turbine blade assembly. The turbine blade assembly may generally include a turbine blade having a root portion and an airfoil. The airfoil may extend radially from the root portion to an airfoil tip. The turbine blade assembly may also include a tip cover coupled to the airfoil at the airfoil tip and a rod extending within the turbine blade. The rod may include a first end coupled to the tip cover and a second end coupled to the root portion. Additionally, the turbine blade assembly may include means for coupling the second end of the rod to the root portion.

In another aspect, the present subject matter discloses a turbine blade assembly. The turbine blade assembly may generally include a turbine blade having a root portion and an airfoil. The airfoil may extend radially from the root portion to an airfoil tip. Additionally, the turbine blade assembly may include a composite rod extending within the turbine blade. The composite rod may include a first end coupled to the airfoil at the airfoil tip and a second end coupled to the root portion. Moreover, the coefficient of thermal expansion of the composite rod may be less than or equal to the coefficient of thermal expansion of the airfoil.

In a further aspect, the present subject matter discloses an assembly for applying a compressive force within a component. The assembly includes an attachment plate defining an opening. The assembly also includes a composite rod having a first end configured to engage the attachment plate at the opening and a second end configured to be inserted through the opening. Additionally, the assembly includes a first clamp plate having a first clamping surface and a second clamp plate having a second clamping surface. The first and second clamp plates may be configured to be positioned around the composite rod such that the first and second clamping surfaces engage the second end of the composite rod.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
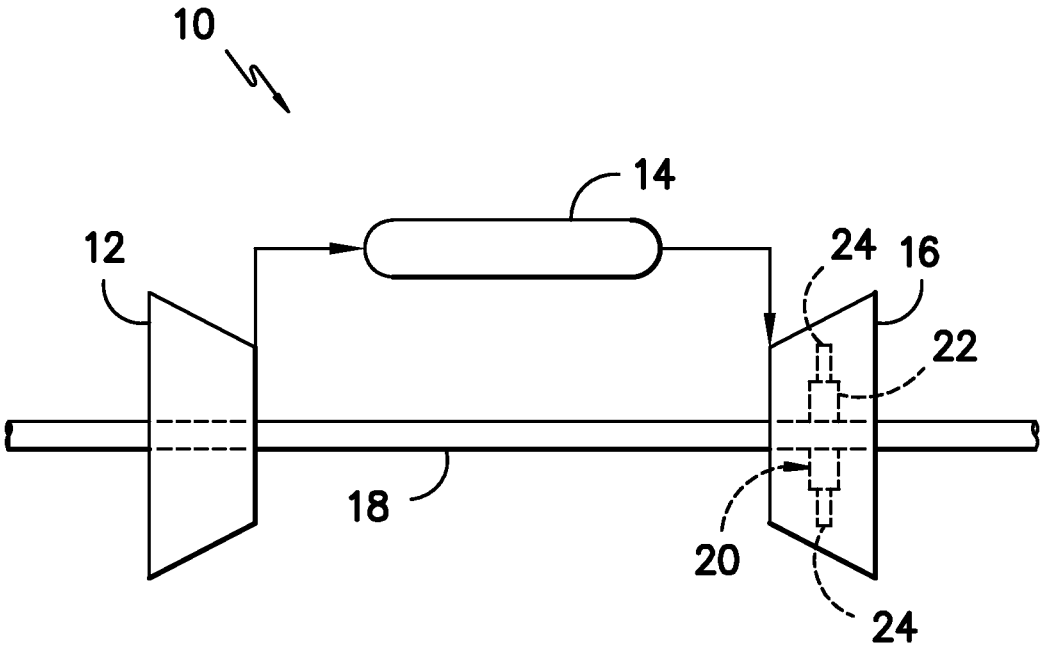
FIG. 1 illustrates a simplified, schematic diagram of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter discloses a turbine blade assembly having a turbine bucket and a compression rod extending radially within the turbine bucket. The compression rod may generally be configured to be coupled to the turbine bucket at opposing ends of the bucket's airfoil in order to provide a compressive force against the airfoil during operation of the gas turbine. As such, the compression rod may reduce the likelihood of creep and other forms of material relaxations and/or property degradation from occurring as the airfoil is thermally and mechanically loaded with increasing operational speeds and temperatures within the gas turbine.

It should be appreciated that, although the present subject matter is described herein with reference to turbine buckets of a gas turbine, the present disclosure is generally applicable to any suitable turbine blade known in the art. For example, the disclosed blade assembly may also be utilized with compressor blades disposed within the compressor section of a gas turbine. Additionally, the present subject matter may be applicable to airfoil components used within other types of turbine systems, such as steam turbines.

Referring to the drawings, FIG. 1 illustrates a schematic diagram of a gas turbine 10. The gas turbine 10 generally includes a compressor section 12, a plurality of combustors (not shown) disposed within a combustor section 14, and a turbine section 16. Additionally, the system 10 may include a shaft 18 coupled between the compressor section 12 and the turbine section 16. The turbine section 16 may generally include a turbine rotor 20 having a plurality of rotor disks 22 (one of which is shown) and a plurality of turbine buckets 24 extending radially outwardly from and being coupled to each rotor disk 22 for rotation therewith. Each rotor disk 22 may, in turn, be coupled to a portion of the shaft 18 extending through the turbine section 16.

During operation of the gas turbine 10, the compressor section 12 supplies compressed air to the combustors of the combustor section 14. Air and fuel are mixed and burned within each combustor and hot gases of combustion flow in a hot gas path from the combustor section 14 to the turbine section 16, wherein energy is extracted from the hot gases by the turbine buckets 24. The energy extracted by the turbine buckets 24 is used to rotate to the rotor disks 22 which may, in turn, rotate the shaft 18. The mechanical rotational energy may then be used to power the compressor section 12 and generate electricity.

Figure 2:
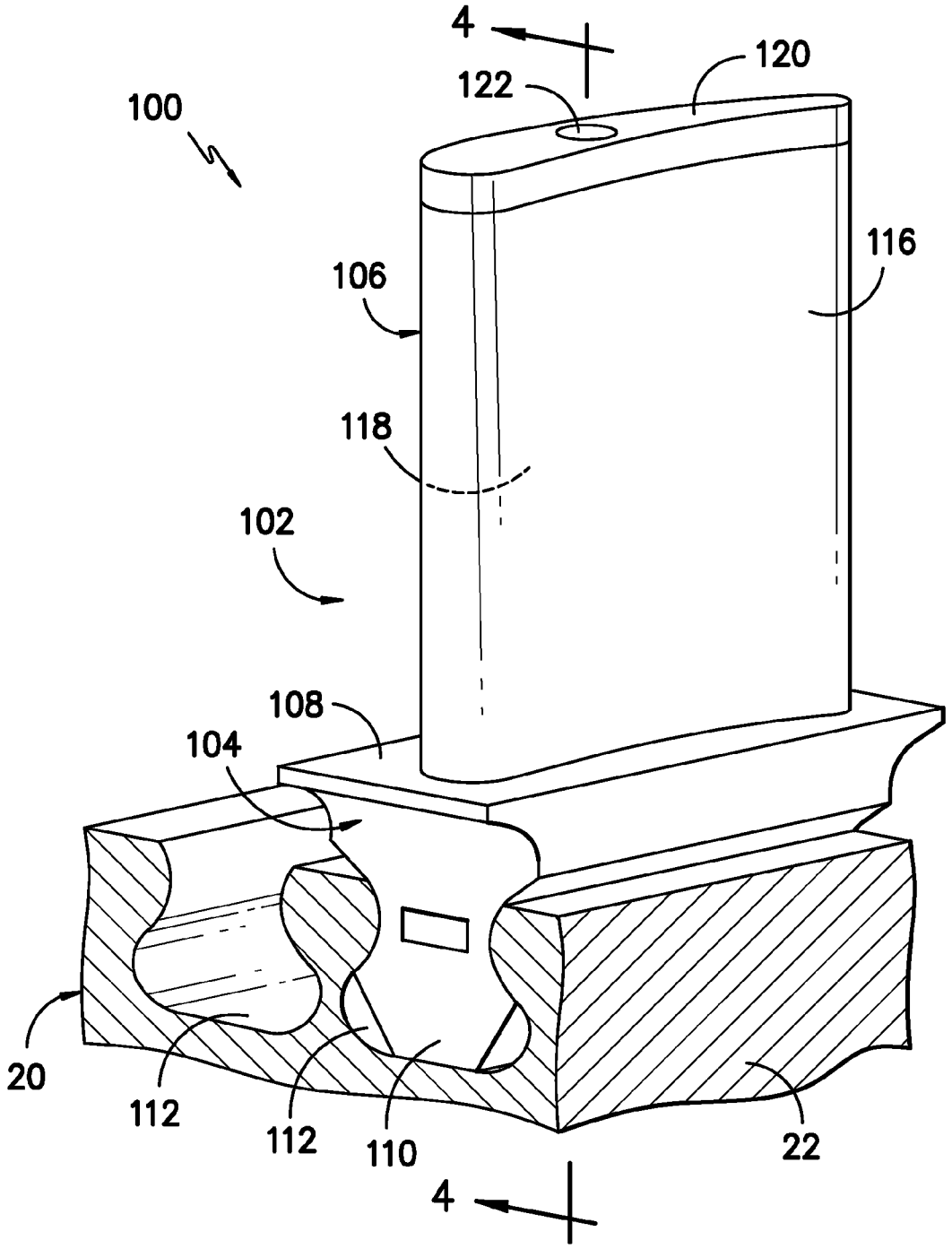
FIG. 2 illustrates a perspective view of one embodiment of a turbine blade assembly in accordance with aspects of the present subject matter.

Referring now to FIG. 2, there is illustrated a perspective view of one embodiment of a turbine blade assembly 100 suitable for use in the disclosed gas turbine 10 in accordance with aspects of the present subject matter. As shown, the blade assembly 100 generally includes a turbine bucket 102 having a root portion 104 and an airfoil 106. The root portion 104 may include a substantially planar platform 108 generally defining the radially inner boundary of the hot gases of combustion flowing through the turbine section 16 of the gas turbine 10 and a root 110 extending radially inwardly from the platform 108. The root 110 may generally serve as an attachment mechanism for coupling the turbine bucket 102 to one of the rotor disks 22 (only a portion of which is shown) of the turbine rotor 20. For example, in several embodiments, each rotor disk 22 may define a plurality of dovetail-shaped slots 112 (two of which are shown) spaced apart around the outer circumference of the disk 22. As such, the root 110 may have a corresponding dovetail shape to allow the root 110 to be received within the slot 112. However, in other embodiments, the root 110 and/or slots 112 may have any other suitable shape and/or configuration that allows the turbine bucket 102 to be coupled to the rotor disk 22.

Figure 3:
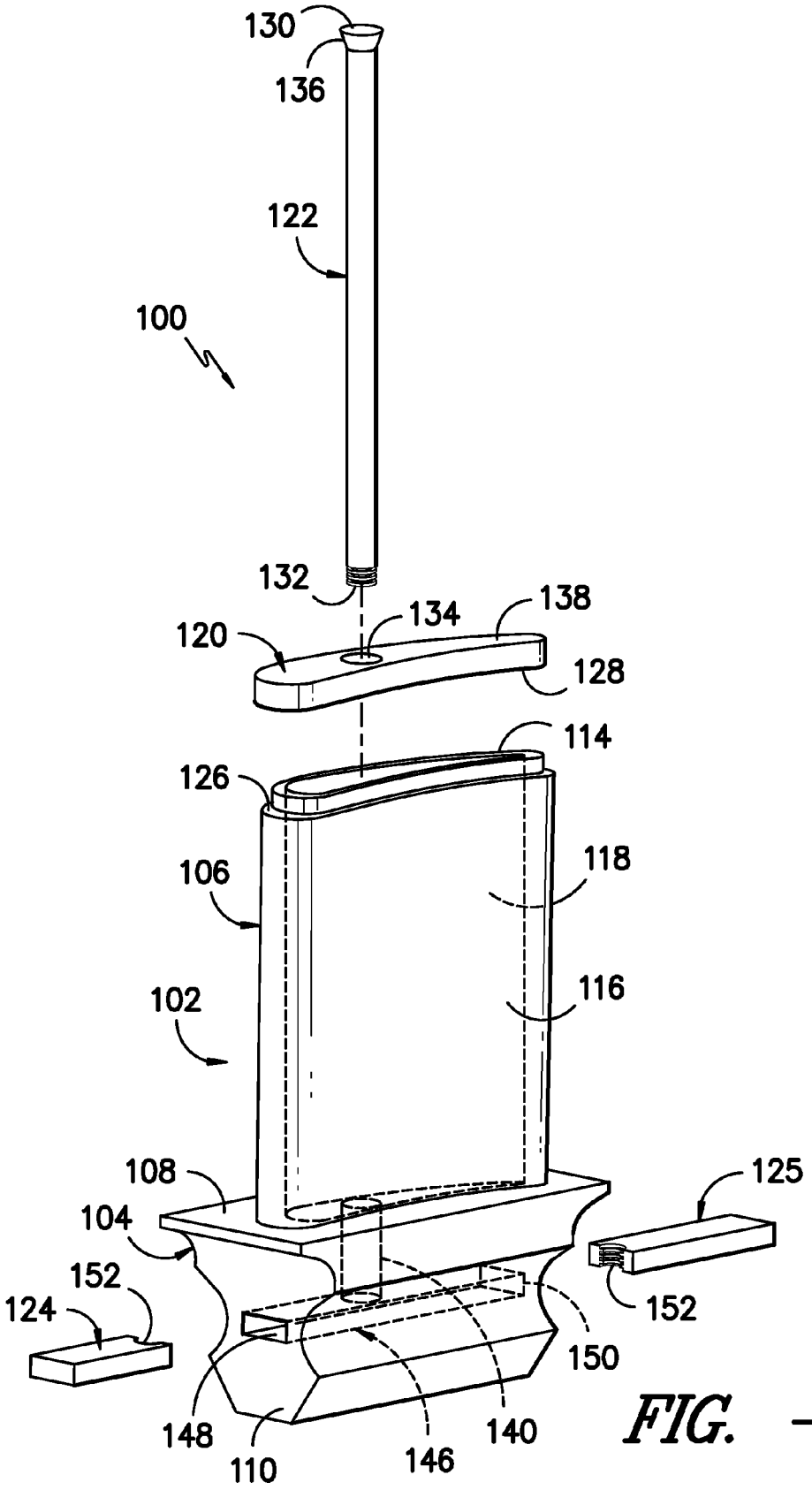
FIG. 3 illustrates an exploded view of the turbine blade assembly shown in FIG. 2.

The airfoil 106 of the turbine bucket 102 may generally extend radially outwardly from the platform 108 so as to project into the hot gas path of the combustion gases flowing through turbine section 16. For example, the airfoil 106 may extend radially outwardly from the platform 108 to an airfoil tip 114 (FIG. 3). Additionally, the airfoil 114 may generally define an aerodynamic shape. For example, the airfoil 114 may be shaped so as to have a pressure side 116 and a suction side 118 configured to facilitate the capture and conversion of the kinetic energy of the combustion gases into usable rotational energy. Further, as shown in the illustrated embodiment, the airfoil 114 may generally have a hollow cross-section. However, in other embodiments, the airfoil 114 may have a solid or a substantially solid cross-section.

It should be appreciated that the turbine bucket 102 may generally be formed from any suitable materials known in the art. However, in several embodiments of the present subject matter, the turbine bucket 102 may be formed from a composite material, such as a ceramic matrix composite (CMC) material. It should also be appreciated that, in several embodiments, the airfoil 106 and the root portion 104 may be formed integrally as a single component.

Additionally, as will be described in greater detail below, the blade assembly 100 may also include various other components. For example, as shown in FIG. 2, the blade assembly 100 may include a separate tip cover 120 configured to be coupled to the airfoil 106 and a compression rod 122 (only a portion of which is shown) configured to extend radially within the turbine bucket 102.

Figure 4:
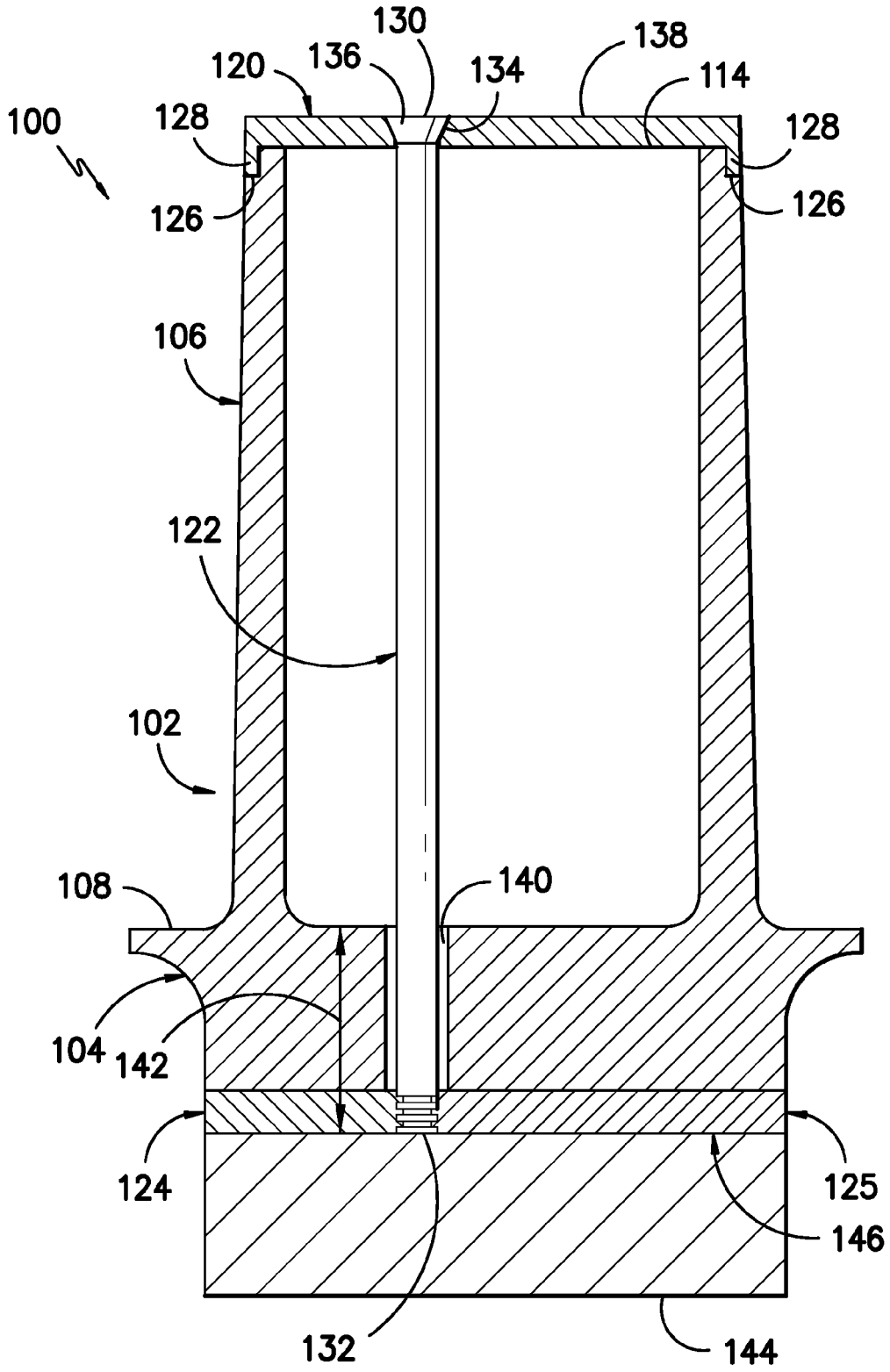
FIG. 4 illustrates a cross-sectional view of the turbine blade assembly shown in FIG. 2, taken along line 4-4.
Figure 5:
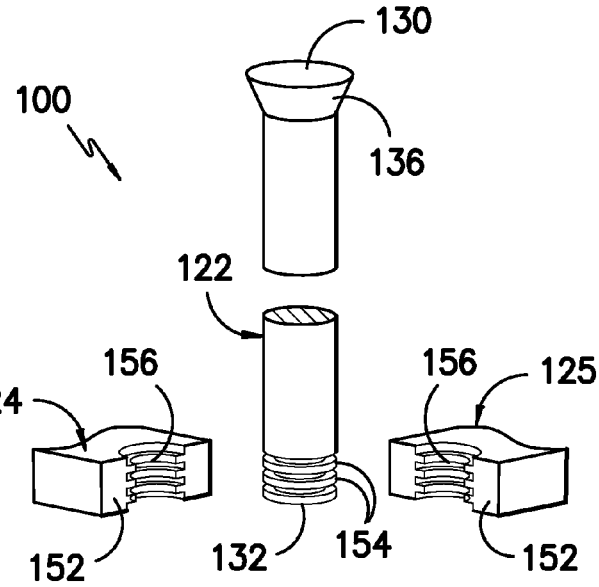
FIG. 5 illustrates a partial, close-up view of several components of the turbine blade assembly shown in FIG. 2, particularly illustrating a portion of the compression rod and a portion of the clamp plates of the turbine blade assembly.

Referring now to FIGS. 3-5, several views of the various components of the blade assembly 100 shown in FIG. 2 are illustrated in accordance with aspects of the present subject matter. In particular, FIG. 3 illustrates an exploded view of the blade assembly 100 shown in FIG. 2. FIG. 4 illustrates a cross-sectional view of the blade assembly 100 shown in FIG. 2, taken along line 4-4. Additionally, FIG. 5 illustrates a close-up view of one embodiment of a portion of the compression rod 122 and a portion of a pair clamp plates 124, 125 of the blade assembly 100.

In general, the tip cover 120 of the blade assembly 100 may be configured to be positioned over and/or around the airfoil 106 at the airfoil tip 114. For example, as shown in the illustrated embodiment, the airfoil 106 may be designed to have a stepped reduction in size at a location adjacent to the airfoil tip 114 such that a circumferentially extending edge 126 is defined in the airfoil 106. In such an embodiment, the tip cover 120 may generally include a radially extending lip 128 configured to engage the circumferential edge 126 when the tip cover 120 is positioned over the airfoil tip 114. Specifically, as shown in FIG. 4, the lip 128 may rest upon and be supported by the circumferential edge 126 when the tip cover 120 is coupled to the airfoil 106. However, it should be appreciated that, in alternative embodiments, the tip cover 120 and/or the airfoil 106 may have any other suitable configuration that allows the tip cover 120 to the coupled to the airfoil 106 at the airfoil tip 114.

Additionally, in several embodiments, tip cover 120 may generally be configured to have a shape or profile corresponding to the shape or profile of the airfoil 114. For example, as shown in FIG. 3, the tip cover 120 may have an aerodynamic profile generally corresponding to the aerodynamic profile of the airfoil 106 at the circumferential edge 126. As such, a generally flush and continuous aerodynamic surface may be defined at the interface between the airfoil 106 and the tip cover 120.

It should be appreciated that the tip cover 120 may generally be formed from any suitable materials known in the art. However, in several embodiments, similarly to the turbine bucket 102, tip cover 120 may be formed from a suitable composite material, such as a CMC material.

Referring still to FIGS. 3-5, the compression rod 122 of the blade assembly 100 may generally be configured to be installed within the turbine bucket 102 so as to be tightly anchored and/or coupled at opposing ends of the airfoil 106. For example, in several embodiments, the compression rod 122 may include a first end 130 configured to be coupled to the tip cover 120 and a second end 132 configured to be coupled to the root portion 104 of the turbine bucket 102. As such, the compression rod 122 may generally extend radially within the turbine bucket 102 along the entire length of the airfoil 106 and, thus, may be capable of applying a clamping or compressive force against the airfoil 106 during operation of the gas turbine 10. In particular, by anchoring and/or coupling the compression rod 122 at opposing ends of the airfoil 106, the compression rod 122 may provide a radially acting force against the airfoil 106 in order to reduce the likelihood of creep and other forms of material relaxations and/or property degradation from occurring as the airfoil 106 thermally expands in response to increasing temperatures within the gas turbine 10.

In general, the first end 130 of the compression rod 122 may be configured to be anchored against and/or coupled to the tip cover 120 using any suitable means. For example, in several embodiments, the tip cover 120 may define an opening 134 having suitable dimensions to allow the compression rod 122 to be radially inserted within the turbine bucket 102. In particular, the opening 134 may be sized such that the second end 132 of the compression rod 122 may be inserted through the opening 134 and moved radially inwardly towards the root portion 104 of the turbine bucket 102. In such embodiments, the first end 130 of the compression rod 122 may generally include an outwardly extending projection or flange 136 configured to catch against and/or engage a portion of the tip cover 120 when the rod 122 is inserted through the opening 134. For instance, as shown in the illustrated embodiment, the flange 136 may have a conical shape generally defining a tapered profile. Similarly, the opening 134 defined in the tip cover 120 may have a conical shape and may define a tapered profile generally corresponding to the tapered profile of the flange 136. As such, when the compression rod 122 is inserted radially through the tip cover 120, the flange 136 may engage the tip cover 120 at the opening 134. Additionally, due to the corresponding tapered profiles, the flange 136 may generally be recessed within the tip cover 120. For example, as shown in FIG. 4, the flange 136 may be recessed within the tip cover 120 such that the first end 130 of the compression rod 122 is substantially flush with an outer surface 138 of the tip cover 120.

However, it should be appreciated that, in alternative embodiments, the compression rod 122 and/or the tip cover 120 may have any other suitable configuration that allows the first end 130 of the compression rod 122 to be anchored against and/or coupled to the tip cover 120. For example, in one embodiment, the flange 136 may be dimensionally larger than the opening 134 defined in the tip cover 120 such that the flange 136 may be engaged against the outer surface 138 of the tip cover 120 when the compression rod 122 is inserted through the tip cover 122. Additionally, depending on the particular materials used to form the compression rod 122 and the tip cover 120, the first end 130 of the compression rod 122 may be welded to the tip cover 120 and/or the first end 130 may be threaded to allow the compression rod 122 to be screwed into a corresponding threaded hole (not shown) defined in the tip cover 120. In an even further embodiment, the tip cover 120 may be formed integrally with the compression rod 122. For example, the tip cover 120 may be formed together with the compression rod 122 such that, when the tip cover 120 is coupled to the airfoil 106 at the airfoil tip 114, the compression rod 122 projects radially into the turbine bucket 102.

Additionally, in several embodiments, the second end 132 of the compression rod 122 may generally be configured to extend radially within the turbine bucket 102 to a location within the root portion 104 of the bucket 102 when the compression rod 122 is installed through the tip cover 120. Thus, an internal cavity 140 may generally be defined in the root potion 104 for receiving the second end 132 of the compression rod 122. For example, as shown in FIG. 4, the internal cavity 140 may extend radially within the root portion 104 any suitable distance 142 from the platform 108 that allows the compression rod 122 to be fully inserted within the turbine bucket 102 (i.e., such that the first end 130 of the compression rod 122 is engaged against the tip cover 120). In another embodiment, the internal cavity 140 may be defined through the entire root portion 104, such as by extending radially from the platform 108 to a bottom surface 144 (FIG. 4) of the root portion 104. Further, it should be appreciated that, in embodiments in which the airfoil 106 is not hollow, the internal cavity 140 may also be configured to extend radially outwardly from the platform 108 to the tip cover 120 so as to accommodate the compression rod 122 within the turbine bucket 102.

Moreover, as indicated above, the second end 132 of the compression rod 122 may be configured to be anchored against and/or coupled to the root portion 104. Thus, in several embodiments of the present subject matter, the second end 132 may be anchored against and/or coupled to the root portion 104 through first and second clamp plates 124, 125 configured to be received within a channel 146 defined in the root portion 106. For example, as shown in FIG. 3, the channel 146 may be defined through the entire root portion 104 and, thus, may include a first open end 148 and a second open end 150. Accordingly, the first clamp plate 124 may be installed within the channel 146 through the first open end 148 and the second clamp plate 125 may be installed within the channel 146 through the second open end 150. Further, as shown in FIG. 4, the channel 146 may be defined in the root portion 106 at a radial location generally corresponding to the radial location of the second end 132 of the compression rod 122. As such, when the first and second clamp plates 124, 125 are inserted into the channel 146, the second end 132 of the compression rod 122 may be engaged between the clamp plates 124, 125.

Additionally, to assist in radially retaining and tightly clamping the compression rod 122 within the turbine bucket 102, each clamp plate 124, 125 may include a clamping surface 152 having an attachment feature defined therein configured to radially and circumferentially engage a corresponding attachment feature formed in the second end 132 of the compression rod 122. For example, as particularly shown in FIG. 5, in one embodiment, one or more circumferential grooves 154 may be formed in the second end 132 of the compression rod 122. As such, the clamping surfaces 152 of each clamp plate 124, 125 may include corresponding grooved recesses 156 configured to extend around a portion of the outer perimeter of the second end 132 and engage the circumferential grooves 154. Thus, when the clamp plates 124, 125 are inserted within the channel 146, the grooved recesses 156 may mate and/or interlock with the circumferential grooves 154, thereby radially retaining the compression rod 122 within the turbine bucket 102.

In alternative embodiments, it should be appreciated that the clamp plates 124, 125 and the second end 132 of the compression rod 122 may generally have any other suitable attachment features that permit the compression rod 122 to be radially retained within the turbine bucket 102 when the clamp plates 124, 125 are inserted into the channel 146. For example, instead of the circumferential grooves 154, the second end 132 of the compression rod 122 may include a conical shaped and/or tapered flange (not shown) similar to the flange 136 formed at the first end 130 of the compression rod 122. In such an embodiment, the clamping surfaces 152 of each clamp plate 124, 125 may include corresponding conical shaped and/or tapered recesses (not shown) such that the clamp plates 124, 125 may radially and circumferentially engage the second end 132 of the compression rod 122.

It should also be appreciated that the clamp plates 124, 125 may generally be retained within the channel 145 using any suitable means. For example, in one embodiment, cover plates (not shown) may be coupled to the root portion 104 at the open ends 148, 150 of the channel 146 to maintain the clamp plates 124, 125 within the channel 146. In another embodiment, retaining pins (not shown) may be inserted through the root portion 104 and into the clamp plates 124, 124 to prevent the plates 124, 125 from backing out of the channel 146.

In further embodiments, as an alternative to using the disclosed clamp plates 124, 125, the second end 132 of the compression rod 122 may be configured to be anchored against and/or coupled to the root portion 104 using any other suitable attachment means and/or methods. For example, in one embodiment, the second end 132 of the compression rod 122 may be welded to the root portion 104. In another embodiment, the second end 132 may be threaded to allow the compression rod 122 to be screwed into a corresponding threaded hole (not shown) defined in the root portion 104. In a further embodiment, a retaining pin (not shown) may be configured to be inserted through the root portion 104 so as to engage the second end 132 of the compression rod 122. For instance, the second end 132 may define an opening, hook or similar attachment feature configured to radially engage the retaining pin when the pin is inserted within the root portion 104. In yet another embodiment, the compression rod 122 may be configured to extend radially through the entire turbine bucket 102 such that the second end 132 may be retained against the bottom surface 144 (FIG. 4) of the root portion 104.

Additionally, similar to the turbine bucket 102 and the tip cover 120, it should be appreciated that the compression rod 122 may generally be formed from any suitable material known in the art. However, in several embodiments, the compression rod 122 may be formed from a composite material, such as a CMC material. It should also be appreciated that, although the compression rod 122 is depicted herein as having a substantially circular cross-sectional shape, the rod 122 may generally have any suitable cross-sectional shape. For example, in alternative embodiments, the compression rod 122 may have a rectangular, elliptical, or triangular cross-sectional shape.

Referring still to FIGS. 3-5, as indicated above, the compression rod 122 may generally be configured to apply a compressive force between the tip cover 120 and the root portion 104 in order to radially clamp the airfoil 106, thereby suppressing creep and other forms of material relaxations and/or property degradation during operation of the gas turbine 10. Thus, one of ordinary skill in the art should appreciate that the compressive loading and/or tension within the compression rod 122 may generally be provided by a variety of different methods.

For example, in one embodiment, the compression rod 122 may be pre-heated prior to being installed within the turbine bucket 102. Thus, as the compression rod 122 cools and radially contracts, a radially acting, compressive force may be generated between the first and second ends 130, 132 of the compression rod 122. As such, the airfoil 106 may be pre-stressed prior to exposure to the operating temperatures within the gas turbine 10. This pre-stressed condition may then be maintained or even increased as the temperatures of the turbine bucket 102 and the compression rod 122 increase during operation of the gas turbine 10.

In alternative embodiments, the airfoil 106 need not be pre-stressed in order to generate a compressive force between the first and second ends 130, 132 of the compression rod 122. Rather, the blade assembly 100 may be configured such that the compressive forces are generated during operation of the gas turbine 10. For example, a thermal gradient may be created between the airfoil 106 and the compression rod 122 during operation of the gas turbine 10 so that the airfoil 106 is subject to greater thermal expansion than the rod 122. In several embodiments, the thermal gradient may be created by supplying a cooling fluid (e.g., purge air from the wheel cavity (not shown) of the gas turbine 10) within the turbine bucket 102 to cool the compression rod 122. For instance, in a particular embodiment, the internal cavity 140 defined in the turbine bucket 102 may be flow communication with a fluid source (not shown) such that fluid may be directed into the cavity 140. As such, a compressive force may be generated as the airfoil 106 expands radially relative to the cooler compression rod 122. It should be appreciated that the creation of such a thermal gradient may be particularly advantageous when the compression rod 122 has a coefficient of thermal expansion (CTE) that is generally equal to or greater than the CTE of the airfoil 106.

In further embodiments, the compression rod 122 may be designed to have a CTE that is less than the CTE of the airfoil 106. Thus, the airfoil 106 may expand at more than the compression rod 122 as the temperatures of such components increase during operation of the gas turbine 10, thereby generating a compressive force between the airfoil 106 and the tip cover 120. For example, in several embodiments, the compression rod 122 and the airfoil 106 may be formed from differing materials, with the material used to form the compression rod 122 having a lower CTE than the material used to form the turbine bucket 102. However, in other embodiments, it may be desirable to form the compression rod 122 and the airfoil 106 from the same materials. For instance, in a particular embodiment of the present subject matter, the compression rod 122 and the airfoil 106 may be formed from the same composite material, such as the same CMC material. In such an embodiment, the stack sequence and fiber orientation of the composite layers 158, 160, 162, 164 (FIG. 6) used to form the compression rod 122 may be specifically tailored to provide a lower CTE to the compression rod 122 than the airfoil 106.

Figure 6:
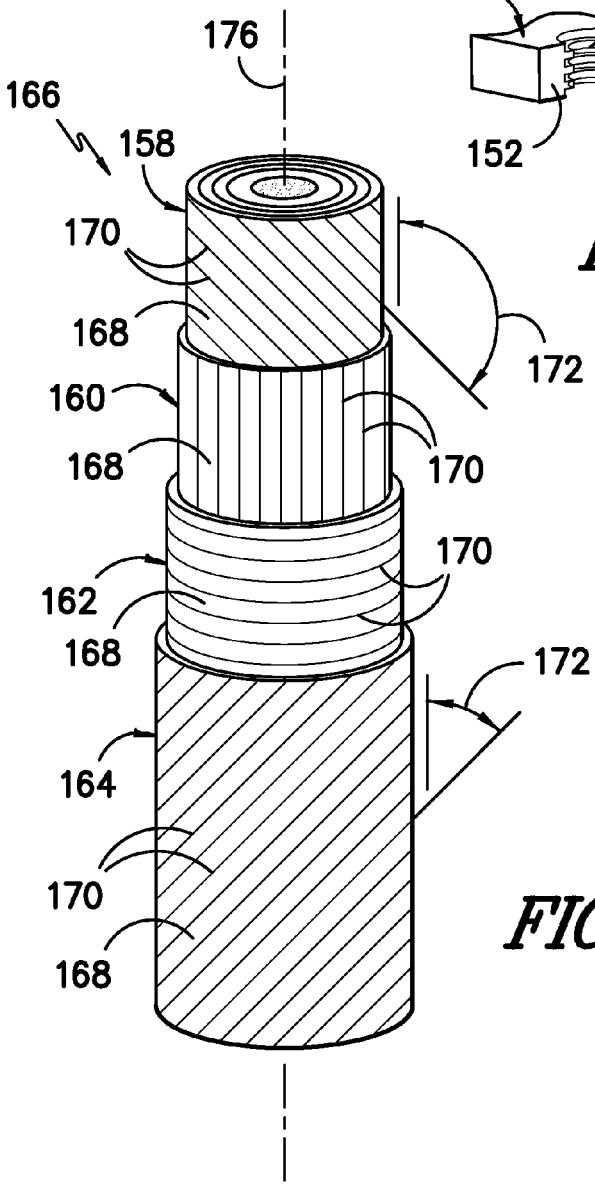
FIG. 6 illustrates a partial, perspective view of one embodiment of an assembly of composite layers that may be used to form a compression rod of the turbine blade assembly in accordance with aspects of the present subject matter.

For example, FIG. 6 illustrates a partial, perspective view of one embodiment of an assembly 166 of composite layers 158, 160, 162, 164 that may be used to form the disclosed compression rod 122, with portions of the outer layers 160, 162, 164 being removed to illustrate portions of the inner layers 158, 160, 162. In general, each composite layer 158, 160, 162, 164 includes a matrix material 168 and a plurality of unidirectional reinforcing fibers 170 extending within the matrix material 168. However, in other embodiments, the composite layers 158, 160, 162, 164 may include bidirectional or multi-directional fibers 170. Additionally, as shown, each composite layer 158, 160, 162, 164 includes a fiber orientation defining a differing fiber angle 172 (measured relative to a centerline 176 of the assembly 166). Specifically, in the illustrated embodiment, the first innermost composite layer 158 includes fibers 170 oriented at a fiber angle 172 of 135 degrees, the second adjacent composite layer 160 includes fibers 170 oriented at a fiber angle 172 of 0 degrees, the third composite layer 162 includes fibers 170 oriented at a fiber angle 172 of 90 degrees and the fourth outermost composite layer 164 includes fibers 170 oriented at a fiber angle of 45 degrees. However, it should be appreciated that the fibers 170 contained within each of the composite layers 158, 160, 162, 164 may generally be oriented at any other suitable fiber angle 172, such as from about 0 degrees to about 180 degrees.

It should also be appreciated that the composite layers 158, 160, 162, 164 may generally be assembled in any suitable stack sequence that provides the desired CTE to the compression rod 122. For instance, in the illustrated embodiment, the assembly 160 is stacked in a fiber orientation pattern (135 degrees, 0 degrees, 90 degrees, 45 degrees) that repeats after every fourth composite layer 158, 160, 162, 164. However, in alternative embodiments, the assembly 166 may include any other suitable combination of fiber orientations stacked in any suitable sequence or pattern. For example, in one embodiment, the assembly 166 may only include composite layers 158, 160, 162, 164 having two differing fiber orientations, such as by having composite layers 158, 160, 162, 164 that alternate between 0 and 90 degree fiber orientations. Of course, one of ordinary skill in the art should appreciate that a vast number of different combinations of stack sequences and fiber orientations may be achieved.

Additionally, it should be appreciated that, in a broader aspect, the present subject matter is also directed to an assembly 200 (FIGS. 7 and 8) for applying a compressive force to one or more components used within severe thermal-mechanical environments, such as within gas turbine engines. For example, in one embodiment, the assembly 200 may comprise the compression rod 122, the tip cover 120 and the clamp plates 124, 125 described above with reference to FIGS. 2-6 and, thus, the assembly 200 may be configured to apply a compressive force to and/or within a turbine bucket 102. However, in alternative embodiments, the assembly 200 may be configured to be utilized with various other suitable high temperature components so as to reduce the likelihood of creep and other forms of material relaxations and/or property degradation from occurring within such components. Thus, referring to FIGS. 7 and 8, there is illustrated another embodiment of an assembly 200 for applying a compressive force to and/or within a component 202 in accordance with aspects of the present subject matter.

Figure 7:
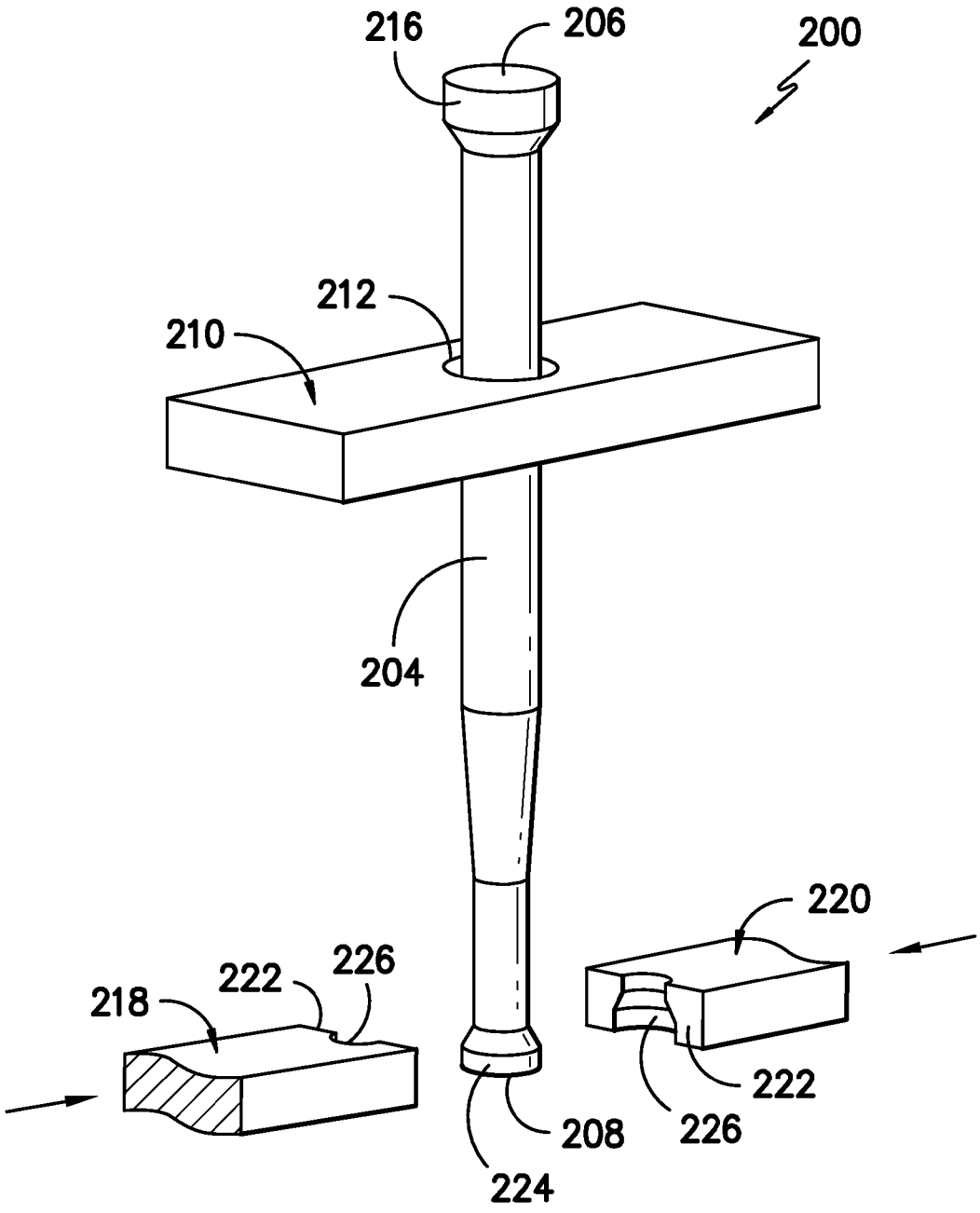
FIG. 7 illustrates an exploded view of one embodiment of an assembly for applying a compressive force within a component in accordance with aspects of the present subject matter.
Figure 8:
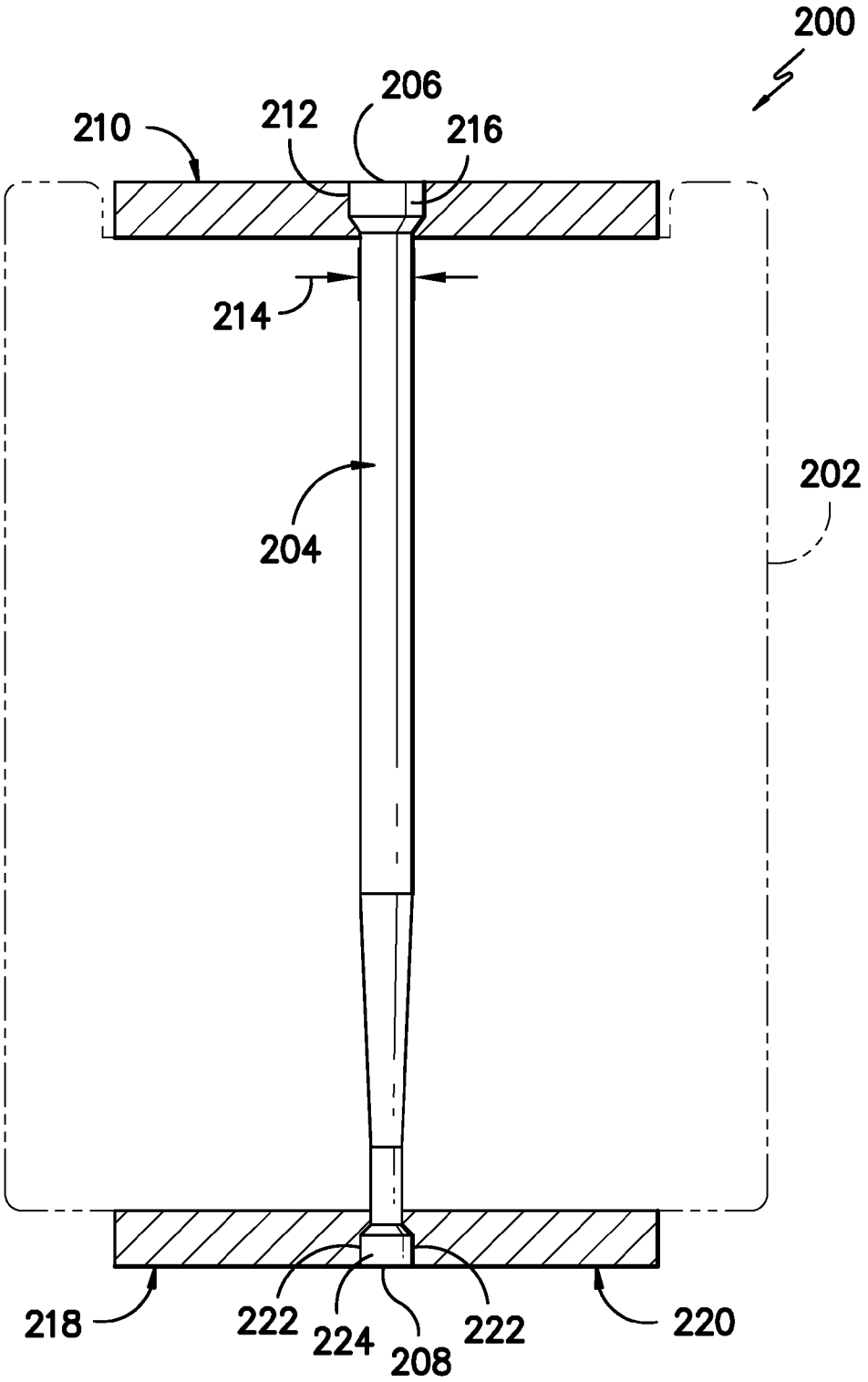
FIG. 8 illustrates a cross-sectional view of the assembly shown in FIG. 7.

As shown, the assembly 200 generally includes a rod 204, an attachment plate 210, a first clamp plate 218 and a second clamp plate 220. The rod 204 may generally be configured the same as or similar to the compression rod 122 described above with reference to FIGS. 2-6. Thus, as shown in FIGS. 7 and 8, the rod 204 may include a first end 206 configured to be anchored against and/or coupled to the component 202 through the attachment plate 210 and a second end 208 configured to be anchored against and/or coupled to the component 202 through the first and second clamp plates 218, 220. As such, the rod 204 may apply a compressive or clamping force to the component 202 as it undergoes thermal expansion to reduce the likelihood of creep and other forms of material relaxations and/or property degradation from occurring. For example, as indicated above, the rod 204 may be pre-stressed within the component 202 or may be designed to have a CTE that is less than the CTE of the component 202, such as by tailoring the stack sequence and/or fiber orientation of the composite layers (not shown) used to form the rod 202.

In general, the first end 206 of the rod 204 may be anchored against and/or coupled to the attachment plate 210 using any suitable means. For example, in several embodiments, the attachment plate 210 may define an opening 212 having suitable dimensions to allow the rod 204 to be inserted through the opening 212. In particular, as shown in FIGS. 7 and 8, a diameter 214 of the opening 212 may be chosen such that the second end 208 of the rod 204 may be inserted through the opening 212 and into the component 202. In such embodiments, the first end 206 of the rod 204 may generally include an outwardly extending projection or flange 216 configured to catch against and/or engage a portion of the attachment plate 210 when the rod 204 is inserted through the opening 212. For instance, as shown in the illustrated embodiment, the flange 216 may diverge outwardly from the rod 204 so as to define a tapered profile. Similarly, the opening 212 defined in the attachment plate 210 may have a tapered profile generally corresponding to the tapered profile of the flange 216. As such, when the rod 204 is inserted through the attachment plate 210, the flange 216 may engage the attachment plate 210 at the opening 212. However, in alternative embodiments, the rod 204 and/or the opening 212 may have any other suitable configuration that allows the first end 206 of the rod 204 to be anchored against and/or coupled to the attachment plate 210.

Additionally, the attachment plate 210 may generally have any suitable configuration that allows the plate 210 to be coupled to and/or engaged against a portion of the component 202 so that the compressive force applied through the rod 204 may be transferred into the component 202. For example, as shown in FIGS. 2-4, in one embodiment, the attachment plate 210 may be configured as a tip cover 122 and may have an aerodynamic shape designed to allow the plate 210 to be coupled to the turbine bucket 102 at the airfoil tip 114. However, in other embodiments, it should be appreciated that the dimensions and/or shape of the attachment plate 210 may generally vary depending on the component 202 in which the assembly 200 is being installed. Moreover, in alternative embodiments, the attachment plate 210 may comprise an integral part of the component 202. For instance, in one embodiment, the opening 212 may be defined in the component 202 such that the first end 206 of the rod 204 is configured to be directly engaged against the component 202. In such an embodiment, the attachment plate 210 may generally comprise the portion of the component 202 in which the opening 212 is formed.

As indicated above, the second end 208 of the rod 204 may generally be configured to be anchored against and/or coupled to the component 202 through the first and second clamp plates 218, 220. Thus, it should be appreciated that the first and second clamp plates 218, 220 may generally have any suitable configuration that allows the clamp plates 218, 220 to be engaged against and/or coupled to a portion of the component 202 so that the compressive force applied through the rod 204 may be transferred into the component 202. For example, as described above with reference to FIGS. 3 and 4, the clamp plates 218, 220 may be configured to be received within a corresponding channel 146 (FIGS. 3 and 4) defined within the component 202. Alternatively, the clamp plates 218, 220 may simply be configured to be engaged against an outer surface of the component 202.

Additionally, to assist in radially retaining and tightly clamping the rod 204 within the component 202, each clamp plate 218, 220 may include a clamping surface 222 having an attachment feature defined therein configured to radially and circumferentially engage a corresponding attachment feature formed in the second end 208 of the rod 204. Thus, in several embodiments, an outwardly extending flange 224 may be formed in the second end 208 of the rod 204. For example, as shown in FIGS. 7 and 8, the flange 224 may diverge outwardly from the rod 204 so as to define a tapered profile. In such an embodiment, the clamping surfaces 222 of the clamp plates 218, 220 may include corresponding tapered recesses 226 configured to extend around a portion of the outer perimeter of the second end 208 and engage the flange 224. Thus, when the clamp plates 218, 220 are positioned around the second end 208 of the rod 204, the flange 224 may be encased within the tapered recesses 226, thereby preventing longitudinal movement of the rod 204 within the component 202.

In alternative embodiments, it should be appreciated that the clamp plates 218, 220 and the second end 208 of the rod 204 may generally have any other suitable attachment features. For example, as described above, the second end 208 may define circumferential grooves 154 (FIG. 5) configured to be received within corresponding grooved recesses 156 (FIG. 5) formed in the clamp plates 218, 220.

It should be appreciated that the rod 204 may generally be formed from any suitable material known in the art. However, in several embodiments, the rod 204 may be formed from a composite material, such as a CMC material. It should also be appreciated that, although the rod 204 is depicted herein as having a substantially circular cross-sectional shape, the rod 204 may generally have any suitable cross-sectional shape. For example, in alternative embodiments, the rod 204 may have a rectangular, elliptical, or triangular cross-sectional shape.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine blade assembly, comprising:

a turbine blade, said turbine blade including a root portion and an airfoil, said airfoil extending radially from said root portion to an airfoil tip;

a tip cover coupled to said airfoil at said airfoil tip, said tip cover defining an opening;

a composite rod extending within said turbine blade, said composite rod including a first end configured to engage said tip cover at said opening and a second end coupled to said root portion, said second end being configured to be inserted radially into said turbine blade through said opening; and a first clamp plate and a second clamp plate configured to be received within a channel defined through said root portion for coupling said second end of said composite rod to said root portion, wherein a coefficient of thermal expansion of said composite rod is less than or equal to a coefficient of thermal expansion of said airfoil.

2. The turbine blade assembly of claim 1, wherein said turbine blade and said composite rod are formed from a ceramic matrix composite material.

3. The turbine blade assembly of claim 1, wherein said composite rod is formed from a plurality of composite layers, said plurality of composite layers including at least two different fiber orientations.

4. The turbine blade assembly of claim 1, wherein each of said first and second clamp plates defines a clamping surface configured to engage said second end of said composite rod when said first and second clamp plates are inserted within said channel.

5. The turbine blade assembly of claim 4, wherein a groove is formed in said second end of said composite rod, said clamping surface including a grooved recess configured to engage said groove.

6. The turbine blade assembly of claim 1, wherein a coefficient of thermal expansion of said composite rod is less than a coefficient of thermal expansion of said airfoil.

7. The turbine blade assembly of claim 1, wherein said opening of said tip cover is dimensionally larger than said second end of said composite rod.

8. The turbine blade assembly of claim 1, wherein said root portion and said airfoil are formed integrally as a single component.

9. A turbine blade assembly, comprising:

a turbine blade, said turbine blade including a root portion and an airfoil, said airfoil extending radially from said root portion to an airfoil tip, said root portion defining a channel;

a tip cover coupled to said airfoil at said airfoil tip;

a rod extending within said turbine blade, said rod including a first end coupled to said tip cover and a second end coupled within said root portion, said second end defining a groove; and a first clamp plate and a second clamp plate configured to be received within said channel, each of said first and second clamp plates including a clamping surface configured to engage said second end of said composite rod when said first and second clamp plates are inserted within said channel, wherein each of said clamping surfaces define a grooved recess configured to engage said groove defined at said second end of said rod.

10. The turbine blade assembly of claim 9, wherein a coefficient of thermal expansion of said rod is less than or equal to a coefficient of thermal expansion of said airfoil.

11. The turbine blade assembly of claim 9, wherein said rod is formed from a plurality of composite layers, said plurality of composite layers including at least two different fiber orientations.

12. The turbine blade assembly of claim 9, wherein said tip cover defines an opening, said rod being configured to be inserted radially into said turbine blade through said opening.

13. The assembly of claim 12, wherein said opening of said attachment plate is dimensionally larger than said second end of said composite rod.

14. The turbine blade assembly of claim 9, wherein said root portion and said airfoil are formed integrally as a single component.

* * * * *